US006688294B1

(12) United States Patent
Kawamura et al.

(10) Patent No.: US 6,688,294 B1
(45) Date of Patent: Feb. 10, 2004

(54) EXHAUST GAS RECIRCULATION VALVE CONTROLLER

(75) Inventors: Satoshi Kawamura, Tokyo (JP); Sotsuo Miyoshi, Tokyo (JP); Toshihiko Miyake, Tokyo (JP); Youichi Fujita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 113 days.

(21) Appl. No.: 10/110,329

(22) PCT Filed: Aug. 24, 2000

(86) PCT No.: PCT/JP00/05718

§ 371 (c)(1),
(2), (4) Date: Apr. 11, 2002

(87) PCT Pub. No.: WO02/16751

PCT Pub. Date: Feb. 28, 2002

(51) Int. Cl.[7] ..... F02M 25/07
(52) U.S. Cl. ..... 123/568.24; 701/108; 123/568.23
(58) Field of Search ..... 123/568.11, 568.23, 123/568.24, 568.16; 701/108

(56) References Cited

U.S. PATENT DOCUMENTS 5,501,201 A * 3/1996 Miyoshi et al. ..... 123/568.24
5,579,743 A * 12/1996 Kadowaki ..... 123/568.24
6,012,437 A * 1/2000 Radhamohan et al. . 123/568.23
6,546,920 B1 * 4/2003 Kawamura et al. .... 123/568.23

FOREIGN PATENT DOCUMENTS

JP 11-159405 6/1999

* cited by examiner

*Primary Examiner*—Henry C. Yuen
*Assistant Examiner*—Arnold Castro
(74) *Attorney, Agent, or Firm*—Sughrue Mion, PLLC

(57) ABSTRACT

The detection of a valve-opening starting position of an exhaust gas recirculation (EGR) valve which is disposed in an exhaust gas recirculation system is surely made, and the amount of movement of a motor shaft of an electric motor in a valve-closing direction is restricted. In this manner, the motor shaft is prevented from striking a stopper which restricts the operating range of the electric motor.

6 Claims, 17 Drawing Sheets

EXHAUST GAS RECIRCULATION VALVE CONTROLLER

TECHNICAL FIELD

This invention relates to an apparatus for controlling an Exhaust Gas Recirculation (hereinafter referred to as EGR) valve which is disposed in an exhaust gas recirculation system.

BACKGROUND ART

FIG. 1 is a schematic arrangement diagram in which a control valve 11 serving as an EGR valve is disposed in an exhaust gas recirculation passage c which communicates an exhaust passage "a" of an engine E and an intake passage b together. In such an apparatus for controlling the EGR valve, the driving of a direct current (DC) motor (hereinafter referred to as electric motor M) is controlled by an engine controller unit (hereinafter referred to as ECU) 51. The opening and closing of the control valve 11 is controlled by the electric motor M. By controlling the electric motor M, the opening degree of the control valve 11 can be adjusted.

Incidentally, in the conventional apparatus for controlling the EGR valve, a predetermined return torque is given to the control valve 11 in the valve-closing direction by an urging means, and a motor torque to vary the control valve 11 in the valve-opening direction is given by the driving of the electric motor M in the valve-opening direction. The control valve 11 is thus opened and closed by the balance of these torque.

As this kind of control apparatus, a description is made for example in JP-A 11-159405(1999) about an arrangement which is provided with: an open loop control system which controls the above-described electric motor M in an open loop manner so as to generate a motor torque depending on a target opening-closing position of the above-described control valve 11; and a feedback control system which controls the electric motor M in a feedback manner based on a deviation between input data corresponding to a targeted opening-closing position of the control valve 11 and detected data of the present opening-closing position of the control valve 11.

A description is first given of the driving method using this electric motor M. In case the opening degree of the control valve 11 is feedback-controlled by the electric motor M, the generated torque of the electric motor M is continuously controlled by feeding back the opening degree of the control valve 11 through continuous detection thereof with a position sensor such as of a sliding resistor type. Thus, the resolution of the adjusting opening degree of the control valve 11 can be infinitely minimized in theory.

The apparatus for controlling the EGR valve using this kind of electric motor M employs a so-called torque balance system. By a spring as an urging means, a predetermined return torque in the valve-closing direction is given and, by driving the electric motor M in the valve-opening direction, a variable motor torque in the valve-opening direction is given. Based on these torque balance, the valve-opening position is determined.

In this kind of control apparatus, since the EGR valve is constantly given the return torque, the opening-closing position (shift amount) varies with the inclination of lines A, B having a hysteresis due to friction as shown in FIG. 2.

Here, line A represents an operating characteristic at the time of opening the control valve 11 by increasing the motor torque, and line B represents an operating characteristic at the time of closing the control valve 11 by decreasing the motor torque. Depending on the spring constant of the spring to give the return torque, the inclination of the operating characteristics A, B change and, depending on the magnitude of the set torque, the operating characteristics A, B shift to right and left in FIG. 2.

Now, in order to control the control valve 11 with this kind of operating characteristics, suppose that there is employed a method in which the electric motor M is subject to a proportional (P) integral (I) control based on a deviation between the input data corresponding to the target opening-closing position of the control valve 11 and the detected data of the present opening-closing position of the control valve. In this case, from the relationship of the operating characteristics A, B as shown in FIG. 2, it becomes difficult to stabilize the control valve 11 in the target opening position.

In other words, in order to open the control valve 11 to the target opening position by increasing the motor torque, the motor torque is increased in order to perform the control along the operating characteristic A in FIG. 2. In this kind of control, in case the valve-opening position has exceeded the target value under the influence of an inertia, interference, or the like, the driving direction is reversed. However, if the hysteresis is present, the movement will not be reversed immediately, but will give rise to a delay. Should the P gain and the I gain be set without considering the delay due to hysteresis, vibrations will occur as shown in FIG. 3. Therefore, if no correction is made to the hysteresis, the P gain and the I gain are restricted, resulting in impairing of the response.

Considering the above-described situation, a description is now given, with reference to FIGS. 4 and 5, about an apparatus for controlling the control valve 11 in a so-called torque balance drive system using the electric motor M. In FIG. 4, reference numeral 1 denotes a valve body having formed therein a passage which forms a part of an exhaust gas recirculation passage c interposed in a recirculation system of the exhaust gas. By an upward movement of the control valve 11 (as illustrated) to thereby contact a valve seat 12, the exhaust gas recirculation passage c is closed and, by a downward movement of the control valve 11 to thereby depart from the valve seat 12, the exhaust gas recirculation passage c is opened.

Reference numeral 2 denotes a motor case for housing therein an electric motor M. In the electric motor M, reference numeral 21 denotes a rotor around which is wound by a coil 22, and reference numeral 23 denotes a yoke provided with a magnet 24. The lower end portion of the rotor 21 is rotatably supported on the valve body 1 by a bearing 27.

Inside the rotor 21, there is threadedly engaged a motor shaft 31. The motor shaft 31 is prevented from relatively rotating by a guide bush 13 on the body 1. Therefore, it follows that the motor shaft 31 moves upward and downward depending on the amount of rotation of the rotor 21. A valve shaft 14 is provided in contact with the lower end of the motor shaft 31, and an intermediate portion of the valve shaft 14 is guided by a guide seal 15 and a guide plate 16 so as to be movable upward and downward. The control valve 11 is attached to the lower end of the valve shaft 14.

Reference numeral 17 denotes a guide seal cover. Between a spring sheet 18 mounted on the upper end of the valve shaft 14 and the guide plate 16, there is interposed a return spring 19 for urging the valve shaft 14 in an upward direction, i.e., for urging the control valve 11 in a valve-closing direction.

The control valve 11 constituted as described above is driven by a torque balance system as described above. In other words, the control valve 11 is given a predetermined return torque in the valve-closing direction of the control valve 11 by the return spring 19 serving as the urging means, and is also given a variable motor torque in the valve-opening direction by the driving of the electric motor M. By the balance of these torque, the open/close of the control valve 11 is controlled.

FIG. 5 is a circuit block diagram showing an engine controller unit (ECU) 51 which supplies the electric motor M with a driving signal. Reference numeral 50 denotes a control part in the form of a microcomputer which determines the driving force of the electric motor M. Reference numeral 52 denotes a battery. Reference numeral 53 denotes a motor driving force converting part which converts the output of the control part 50 for supplying to the electric motor M, and is made up of: a Zener diode 53*a*; a diode 53*b* for forcing the current flow to the electric motor M unidirectional; a field-effect transistor (FET) 53*c*; and an interface 53*d* which is provided between the control part 50 and the FET 53*c*. Reference numeral 56 denotes a regulator to ensure a driving voltage (5V) for the control part 50.

The control part 50 receives as inputs through interfaces 58, 59, respectively, a detected signal from an operating state amount sensor 57 mounted on each part of the vehicle such as a crank angle sensor or the like, as well as a detected signal from a position sensor 40. The position sensor 40 in this example is provided with a movable contact part 42 for moving on a resistor 41 to which is applied a constant voltage (5V) from a voltage supply part 60. By the movement of the movable contact part 42 caused by the rotation of the rotor 21, a voltage corresponding to the moving position of the motor shaft 31 is outputted, as a detected signal, from the movable contact part 42.

Further, the above-described motor driving force converting part 53 switches on and off the voltage to be applied to the electric motor M at a constant period. By a pulse-width modulation (PWM) signal depending on the ratio of on-time and off-time per a period (driving duty), the FET 53*c* is operated by switching, thereby controlling an average driving voltage to be applied to the electric motor M.

Since the conventional apparatus for controlling the EGR valve is constituted as described above, there is the following problem, i.e., in case the closing position of the control valve changes with the lapse of time due to wear of the control valve, the valve seat, or the like, the open position of the control valve and the rotor origin point of the electric motor deviate from each other, with the result that the valve-opening starting position with which the valve opening of the control valve is started changes and that the control valve can no longer be accurately controlled.

This invention has been made to solve the above and other problems and has an object of obtaining an apparatus for controlling an EGR valve in which the valve-opening starting position is accurately detected and the valve opening control is accurately performed.

Further, this invention has an object of obtaining an apparatus for controlling an EGR valve in which the motor shaft can be prevented, at the time of valve closing, from strongly striking a stopper which restricts the operating range of the electric motor.

DISCLOSURE OF THE INVENTION

An apparatus for controlling an exhaust gas recirculation (EGR) valve comprises: a valve shaft having an open-close valve; a return spring for urging the valve shaft in a valve-closing direction; an electric motor for driving in a valve-opening direction a motor shaft abutting the valve shaft; a position detecting sensor for detecting a position of the motor shaft; and a computing means for computing a valve-opening starting position based on a detected signal of the position detecting sensor which detects, through movement of the motor shaft back and forth in both the valve-opening direction and the valve-closing direction, related positions of the motor shaft and the valve shaft at the time of the movement.

According to this arrangement, it is possible to accurately detect the valve-opening starting position at which the valve starts to open, without requiring a complicated apparatus constitution, thereby enabling to accurately control the amount of opening the valve.

The apparatus for controlling an EGR valve according to this invention is characterized in that opening and closing operation of the open-close valve is repeated several times prior to an operation of detecting the valve-opening position.

According to this arrangement, the seating situation of the valve on the valve seat is improved. As a result, the detection of the valve-opening starting position is performed surely and accurately, whereby the amount of valve opening can be controlled more accurately.

The apparatus for controlling an EGR valve according to this invention further comprises an assisting spring for urging the motor shaft in a direction opposite to that of the return spring, the urging being made with a force smaller than that of the return spring.

According to this arrangement, the motor shaft pushed back by the urging force of the return spring at the time of closing the valve is prevented from being strongly striking a stopper which restricts the operating range of the electric motor, thereby preventing the motor shaft from being damaged. Further, the valve-opening position at which the valve starts to open is accurately detectable, whereby the amount of valve opening is accurately controllable.

The apparatus for controlling an EGR valve according to this invention is characterized in that the computing means: drives the electric motor, thereby opening the open-close valve by urging the valve shaft with the motor shaft; thereafter sequentially weakens the driving force of the electric motor so as to move the valve shaft in the valve-closing direction by an urging force of the return spring, thereby detecting a motor shaft position at the time of valve closing as a fully-closed position; further moves the motor shaft in a direction away from the valve shaft and thereafter moves the motor shaft once again in a direction to come into contact with the valve shaft, thereby detecting the contact position of the motor shaft with the valve shaft as a confirmation position; and if a deviation between the confirmation position and the fully-closed position falls within a tolerance (tolerable deviation), makes the fully-closed position as the valve-opening starting position.

According to this arrangement, the valve-opening starting position at which the valve starts to open can be accurately detected and, therefore, the amount of the valve opening can be accurately controlled.

The apparatus for controlling an EGR valve according to this invention is characterized in that the computing means: drives the electric motor, thereby opening the open-close valve by urging the valve shaft with the motor shaft; thereafter sequentially weakens the driving force of the electric motor so as to move the valve shaft in a valve-closing direction by an urging force of the return spring, thereby detecting the motor shaft position at the time of valve closing as a fully-closed position; further moves the motor shaft in a direction away from the valve shaft and thereafter moves the motor shaft once again in a direction to come into contact with the valve shaft, thereby detecting the contact position of the motor shaft with the valve shaft as a confirmation position; and if a deviation between the confirmation position and the fully-closed position falls outside a tolerable deviation, repeats the above-described operations once again to thereby detect whether the deviation between the confirmation position and the fully-closed position falls within the tolerable deviation.

According to this arrangement, the valve-opening starting position at which the valve starts to open can be accurately detected and, therefore, the amount of opening the valve can be accurately controlled.

The apparatus for controlling an EGR valve according to this invention is characterized in that the computing means: sequentially increases a driving force to be supplied to the electric motor in the valve-opening direction, thereby detecting a duty at which the driving force changes as a result of contact of the motor shaft with the valve shaft; opens the open-close valve by sequentially increasing the driving force of the electric motor and thereafter closes the open-close valve by sequentially decreasing the driving force of the electric motor, thereby detecting a duty at which the driving force changes as a result of departing of the motor shaft from the valve shaft; and if a deviation between this duty and the earlier detected duty falls within a tolerable deviation, makes that position of the motor shaft at which the earlier detected duty was detected as the valve-opening starting position.

According to this arrangement, the valve-opening starting position at which the valve starts to open can be accurately detected and, therefore, the amount of operating the valve opening can be accurately controlled.

BEST MODE FOR CARRYING OUT THE INVENTION

In order to explain the present invention in more detail, the best mode for carrying out the present invention will now be described with reference to the accompanying drawings.

EMBODIMENT 1

Figure 6:
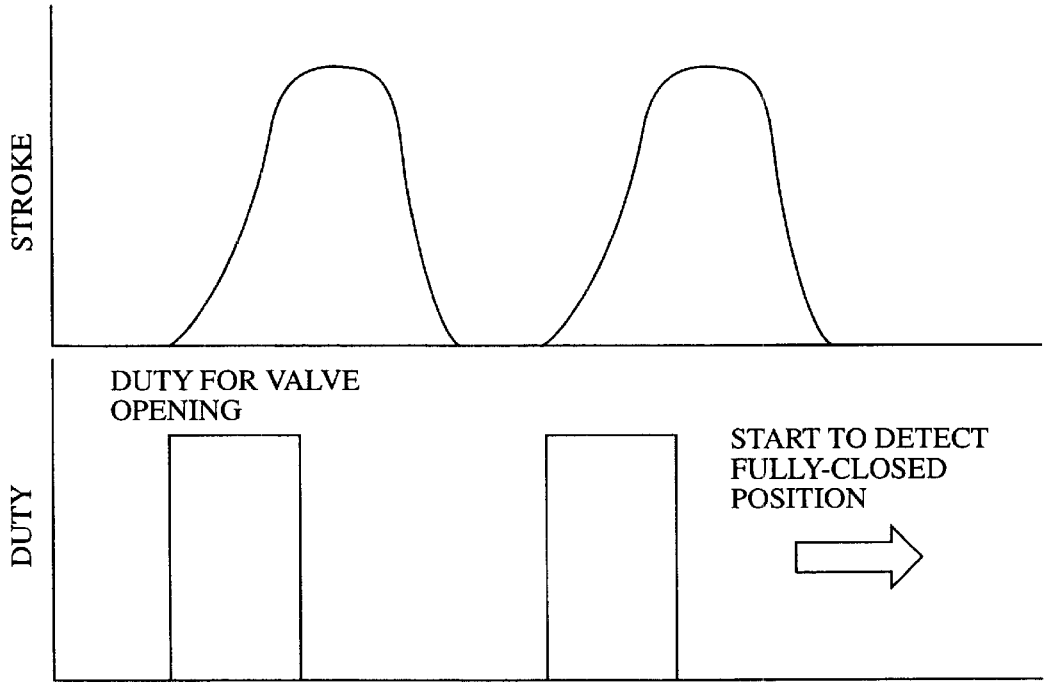
FIG. 6 is an explanation diagram for operation of valve opening and closing at the time of detecting the valve-opening position.
Figure 7:
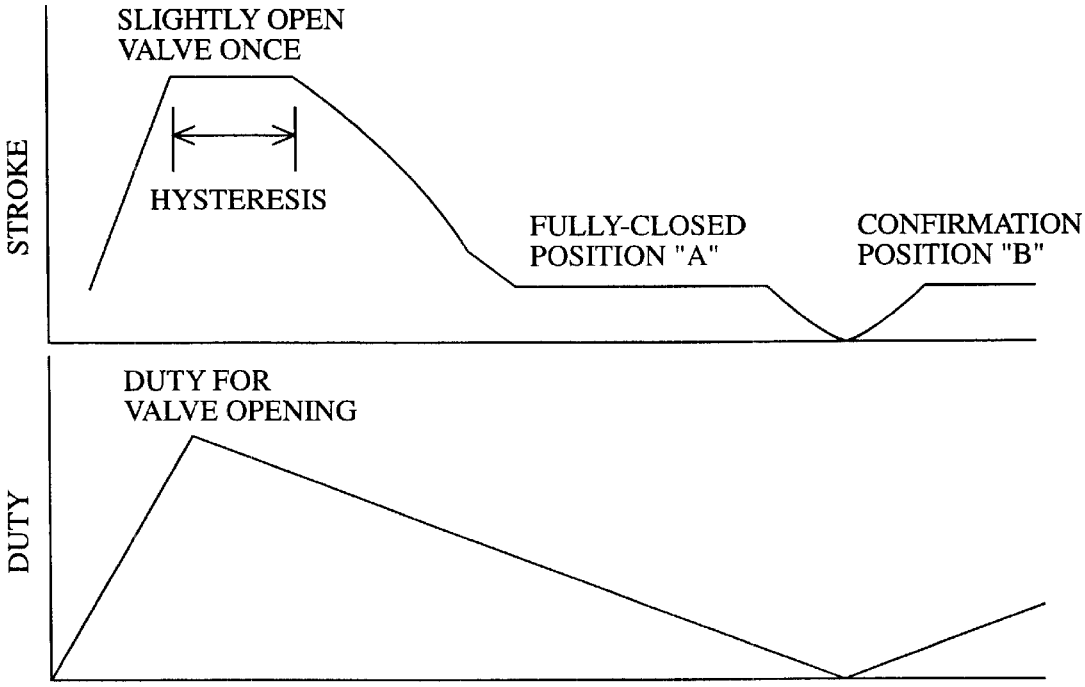
FIG. 7 is a diagram showing the relationships between stroke change of motor shaft and motor driving force (duty) with respect to time upon detecting the valve-opening position according to this invention.

A description is given of an operation for detecting a valve-opening position in the present invention. First, as shown in FIG. 6, there are repeated several times an operation of opening a valve by giving a valve-opening driving force (duty) to an electric motor M and then immediately making the driving force to "0" to thereby close the valve by the urging force of the return spring. Thereafter, as shown in FIG. 7, by driving the electric motor M, a valve shaft 14 is moved by pushing with a motor shaft 31 to thereby open the valve. Thereafter, by sequentially weakening the driving force of this electric motor M, the valve shaft 14 is moved by the urging force of a return spring 19 in the valve-closing direction to detect the position of the motor shaft at the time of valve closing as a fully-closed position (region A in FIG. 7). Further, after moving the motor shaft 31 in the direction away from the valve shaft 14, the motor shaft 31 is moved again in the direction of coming into contact with the valve shaft 14 to thereby detect the position of contact of the motor shaft 31 with the valve shaft 14 as a confirmation position (region B in FIG. 7). If a deviation between this confirmation position and the fully-closed position falls within a tolerance (tolerable deviation), the fully closed position is defined as a valve-opening starting position.

Figure 8:
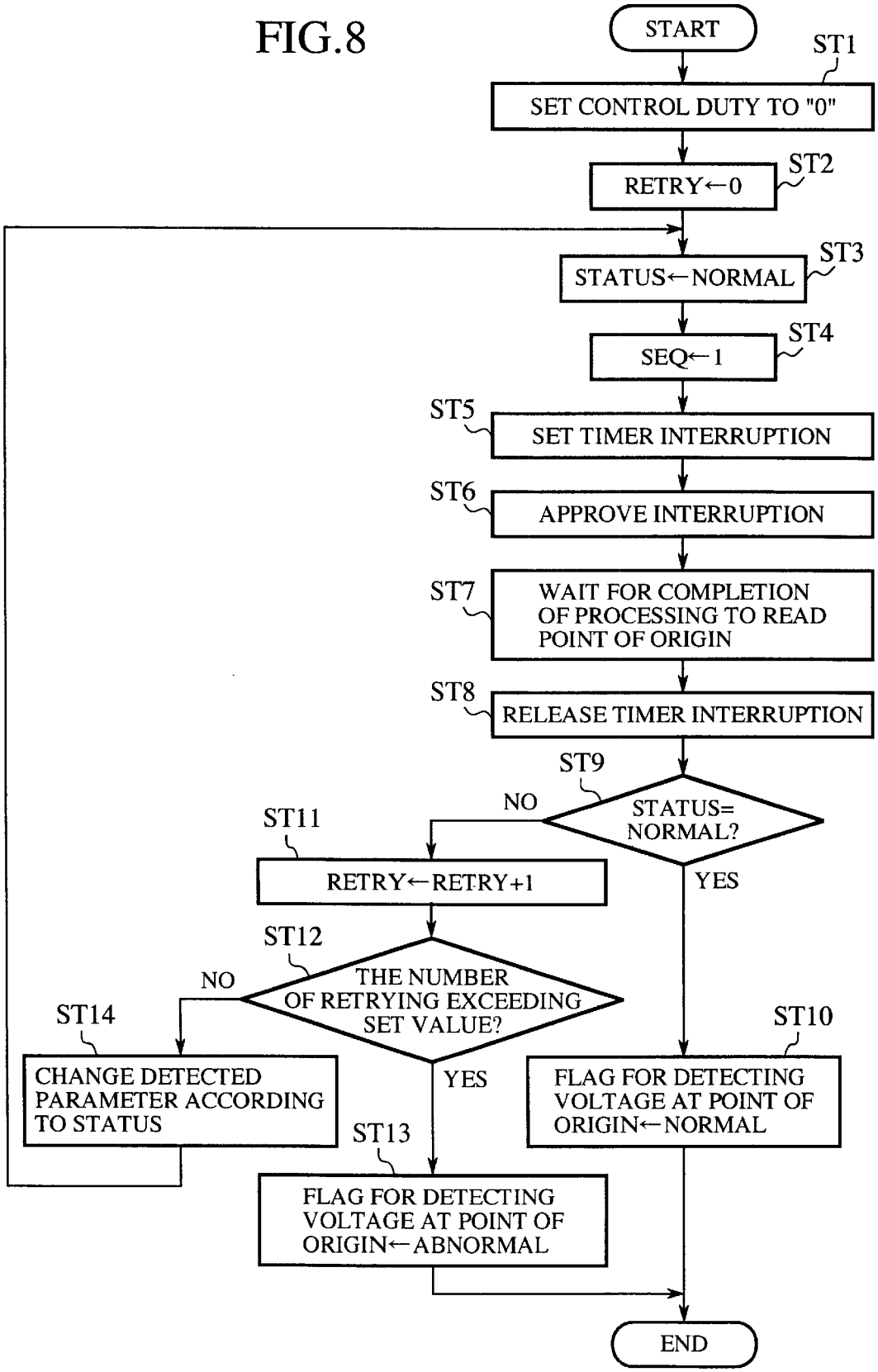
FIG. 8 is a flow chart describing the operation of the control apparatus of this invention.

Hereinbelow, a description is given of the operation of the entire apparatus inclusive of the operation of detecting the valve-opening starting position with reference to FIGS. 8 through 19. In FIG. 8, when the operation is started, the control duty is first set to "0" and also "RETRY" is set to "0." "STATUS" is set to "NORMAL", "SEQUENCE" is set to "1", the timer interruption is set, an approval for interruption is given, and the completion of processing to read the point of origin is waited for (step ST1 through step ST7).

Figure 9:
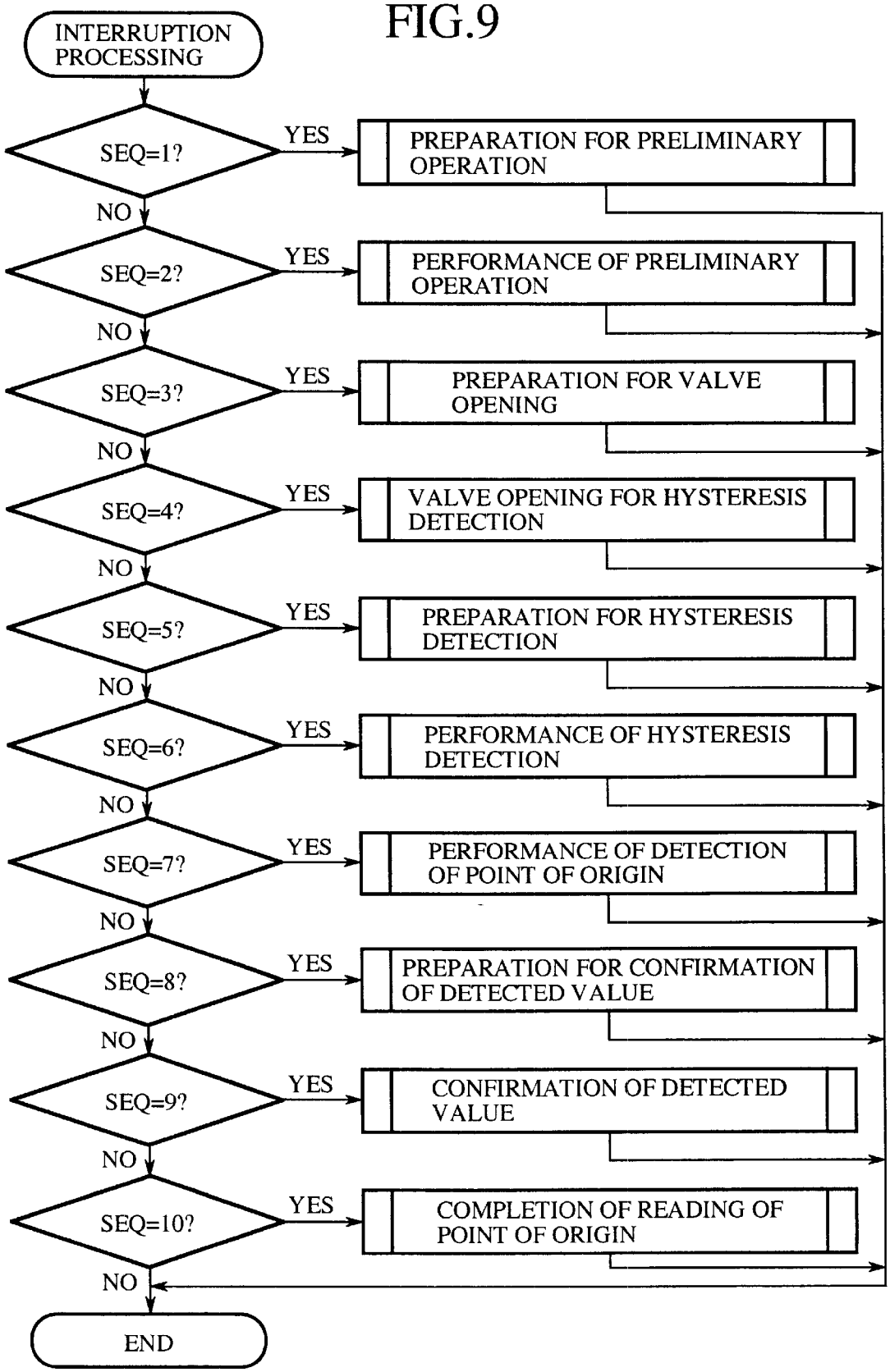
FIG. 9 is a flow chart describing an interrupting processing of this invention.
Figure 10:
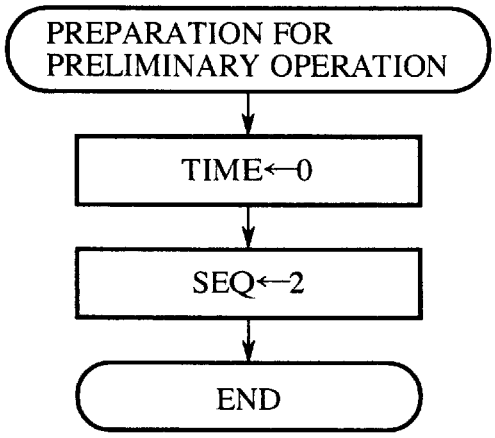
FIG. 10 is a flow chart of preparation for a preliminary operation.
Figure 12:
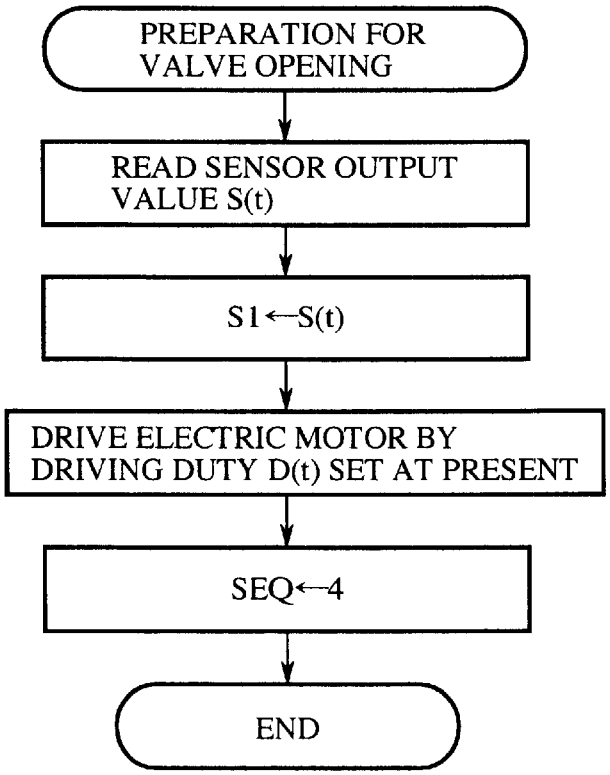
FIG. 12 is a flow chart of valve-opening preparation.
Figure 11:
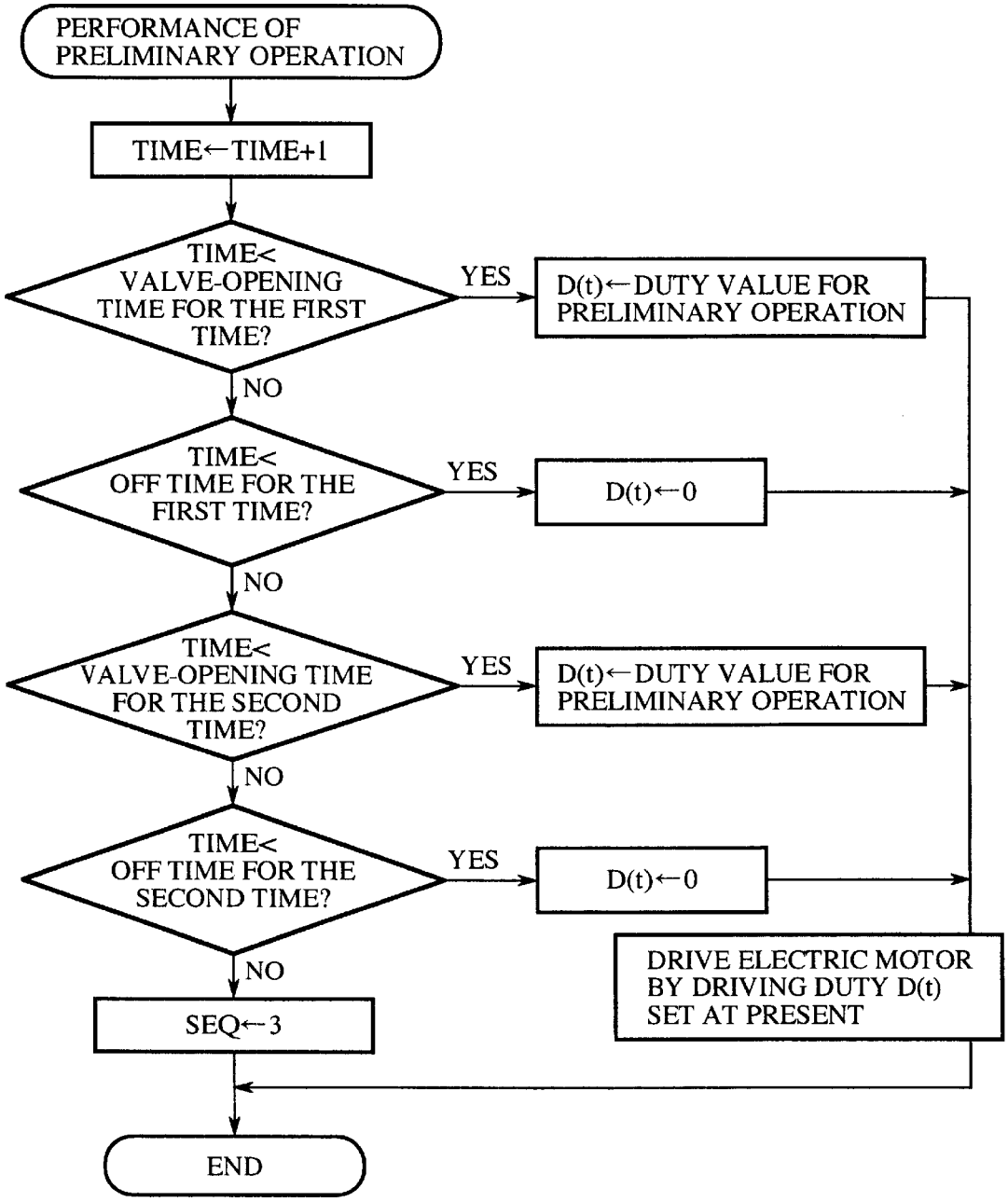
FIG. 11 is a flow chart of executing the preliminary operation.
Figure 13:
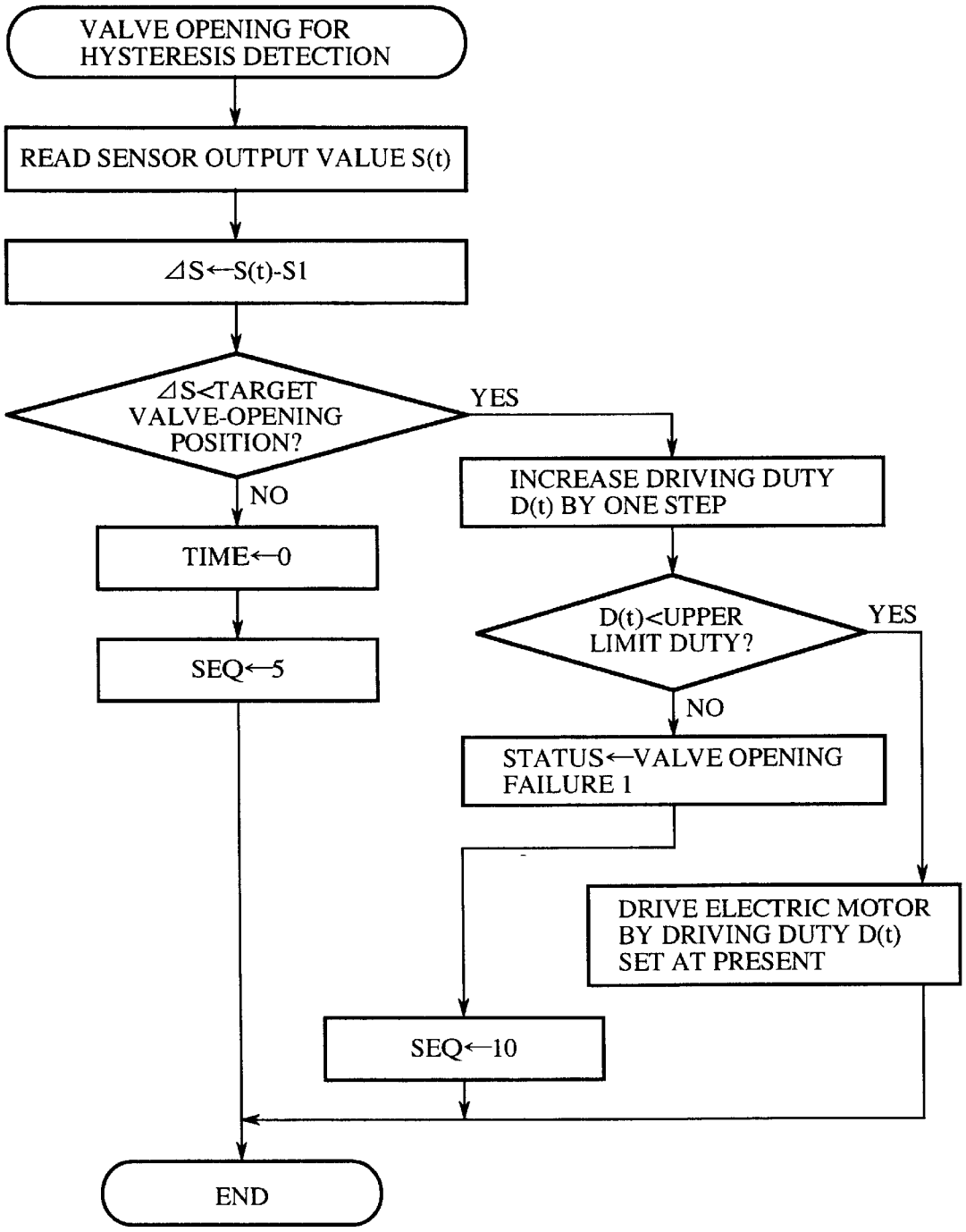
FIG. 13 is a flow chart of valve closing for hysteresis detection.
Figure 14:
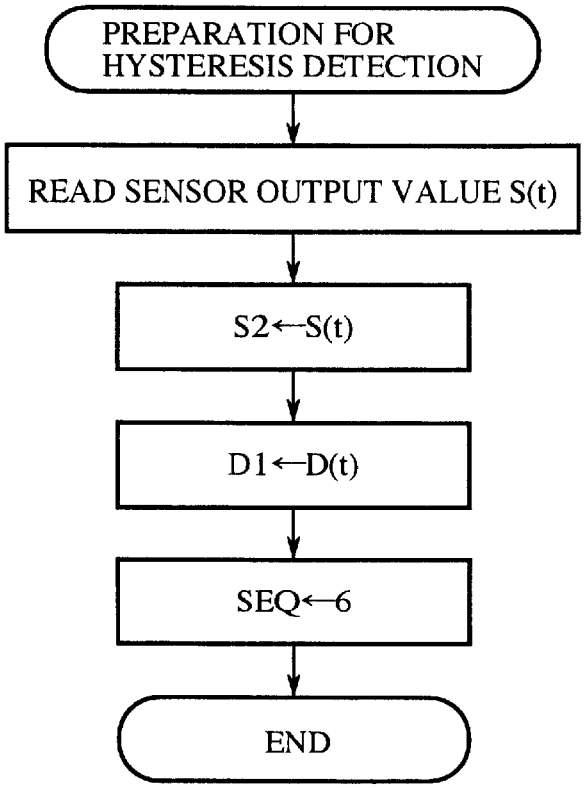
FIG. 14 is a flow chart of preparing the hysteresis detection.
Figure 19:
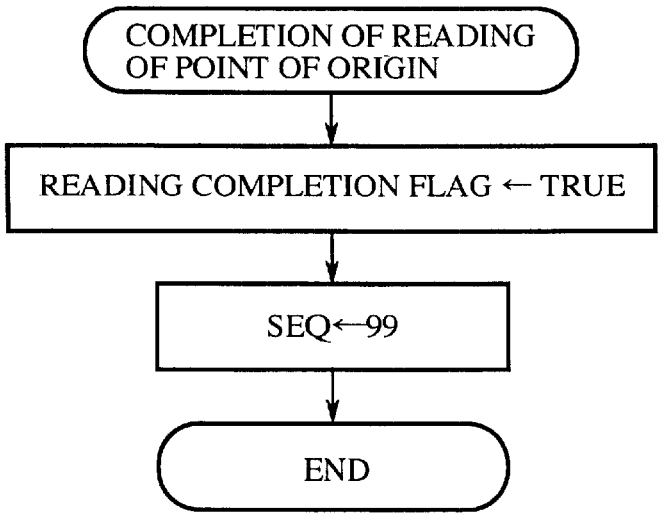
FIG. 19 is a flow chart of completion of reading of the point of origin.
Figure 15:
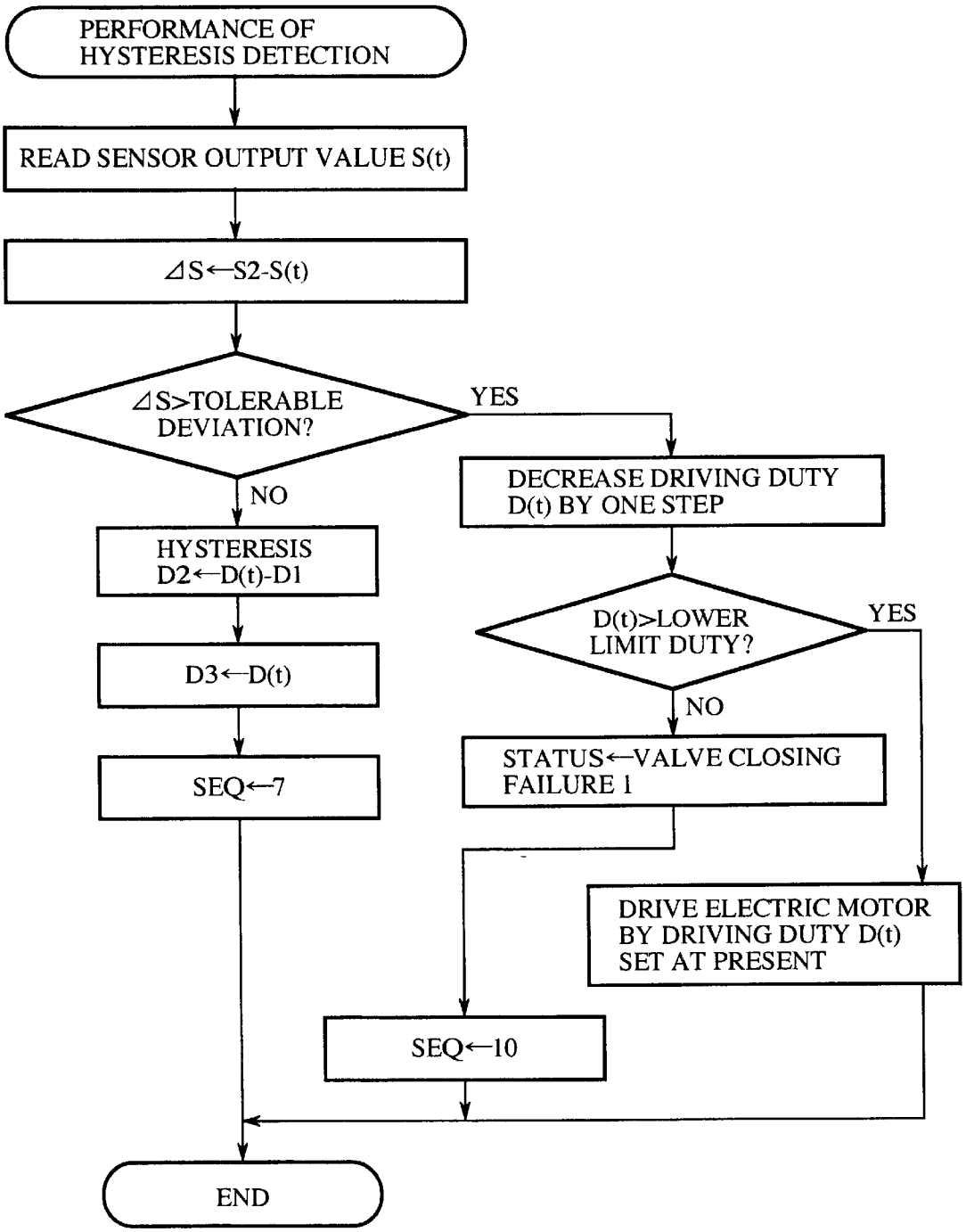
FIG. 15 is a flow chart of performing the hysteresis detection.
Figure 16:
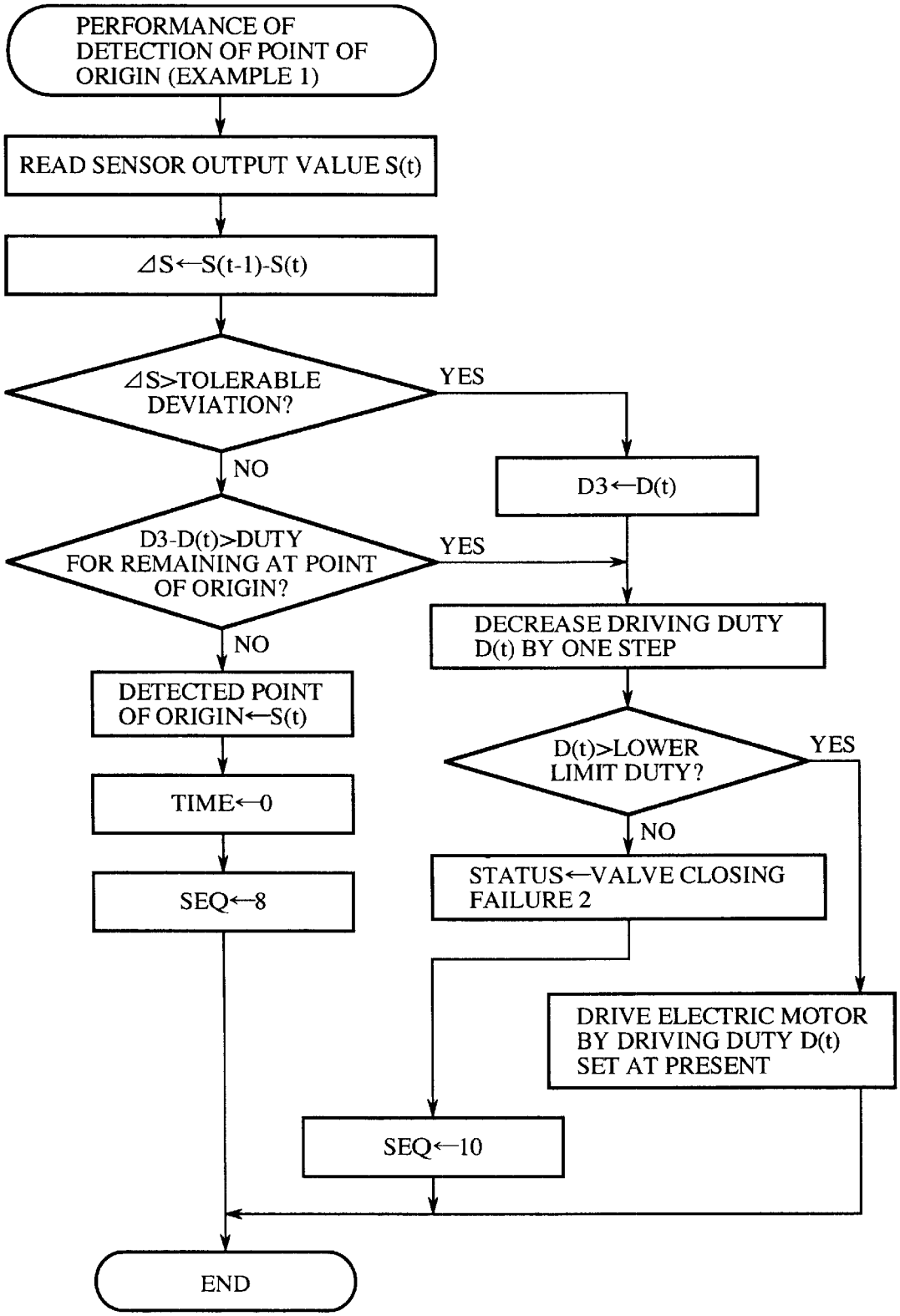
FIG. 16 is a flow chart of performing the detection of point of origin.
Figure 17:
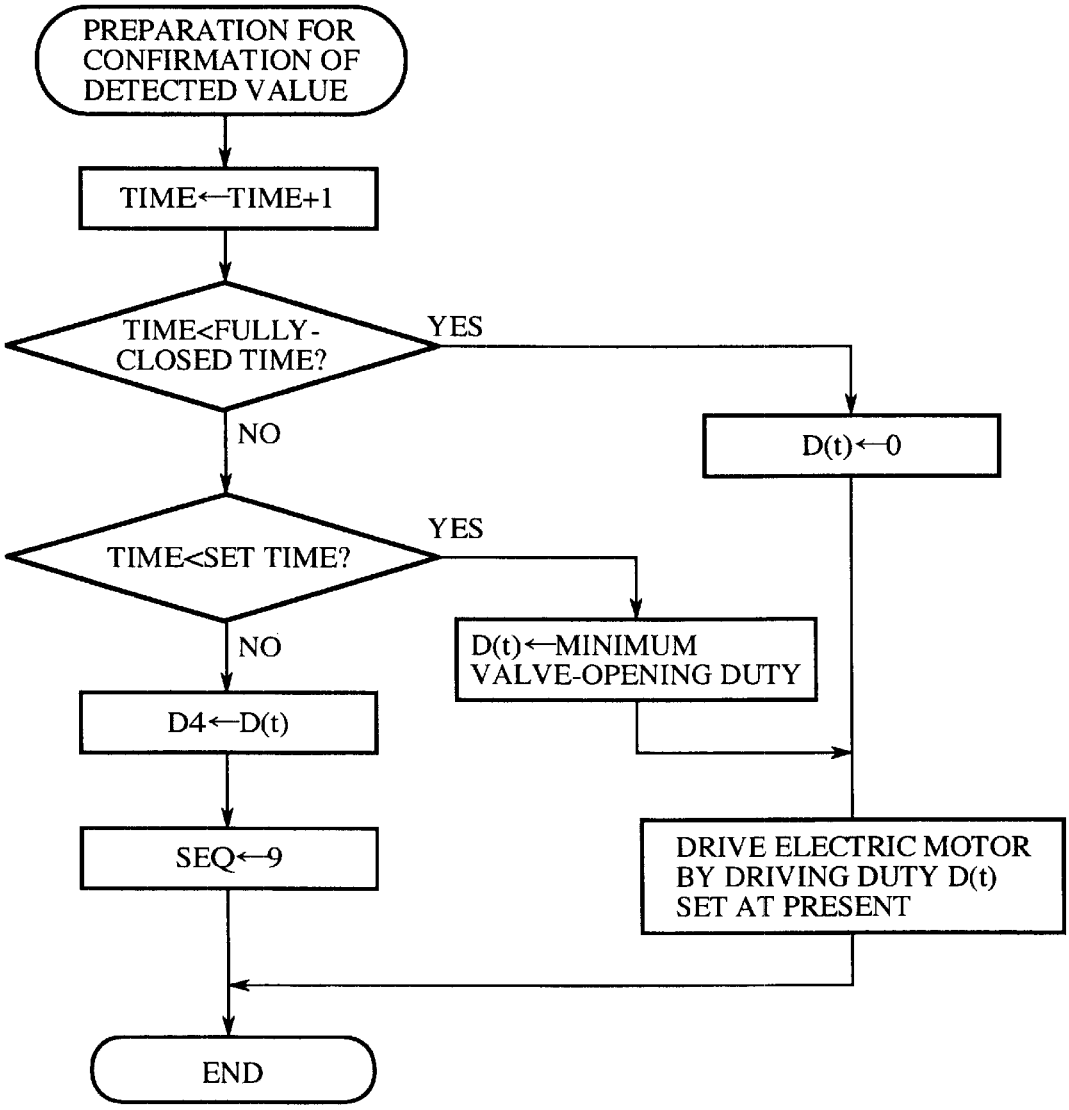
FIG. 17 is a flow chart of preparation for confirmation of detected value.
Figure 18:
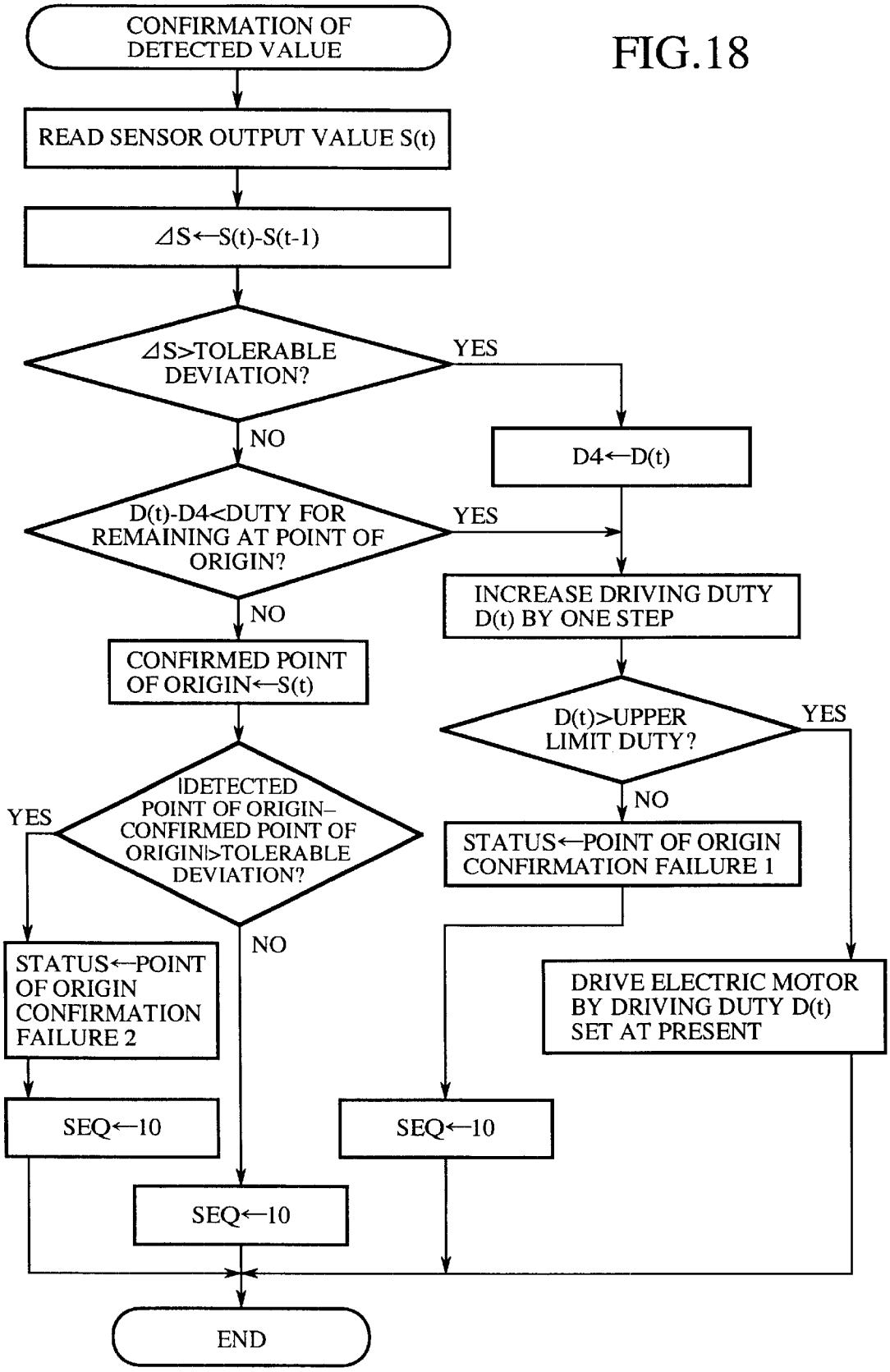
FIG. 18 is a flow chart of confirming the detected value.

Then, the program transfers to an interruption processing as shown in FIG. 9. A determination is made whether the sequence is "1" or not. If the result of the determination is YES, the program transfers to the preparation for a preliminary operation as shown in FIG. 10, and the sequence is made to "2" in the course of performing this preparation for the preliminary operation. After carrying out the performance of the preliminary operation shown in FIG. 11, the sequence is made to "3". Thereafter, in accordance with sequence transferrings of "4" through "10", there will be carried out each of the interruption operations of: valve-opening preparation as shown in FIG. 12; valve opening for hysteresis detection as shown in FIG. 13; preparation for hysteresis detection as shown in FIG. 14; performance of hysteresis detection as shown in FIG. 15; performance of detection of the point of origin as shown in FIG. 16; preparation for confirming a detected value as shown in FIG. 17; confirmation of the detected value as shown in FIG. 18; and completion of reading of the point of origin.

In the marks used in the aforementioned flow charts, "RETRY" denotes the number of operations; "STATUS2 denotes representation of states such as normal, abnormal, and the like; "SEQ" denotes sequence; "TIME" denotes interruption time given to each sequence; D(t) and D1 through D4 denote the DUTY which is the driving force to be given to the electric motor; and Δ S denotes the deviation between the present sensor output value S(t) and the previous sensor output value S (t−1), respectively. The tolerable deviation and the target valve-opening position are arbitrarily determined in advance.

After the above-described interruption operations have been finished, the timer interruption is released (step ST8), and a determination is made as to whether the status is normal or not (step ST9). If the result of the determination is YES, a flag for detecting the voltage at the point of origin is made to be normal (step ST10) and the operation is completed.

On the other hand, if the determination result at step ST9 is NO, RETRY is set to "1" (step ST11), and a determination is made whether the number of retrying has exceeded a set value or not (step ST12). If the determination result is YES, the flag for detecting the voltage at the point of origin is made to be abnormal (step ST13) and the operation is completed. In addition, if the result of determination at step ST12 is NO, the detected parameter, e.g., the driving duty of the electric motor M is changed according to the status so that the program returns to the step ST3 to thereby repeat the operations of step ST3 and downward (step ST14).

As described above, according to the embodiment 1, the amount of valve opening may be accurately controlled by enabling to accurately detect the valve-opening starting position at the time of opening the valve.

EMBODIMENT 2

Figure 20:
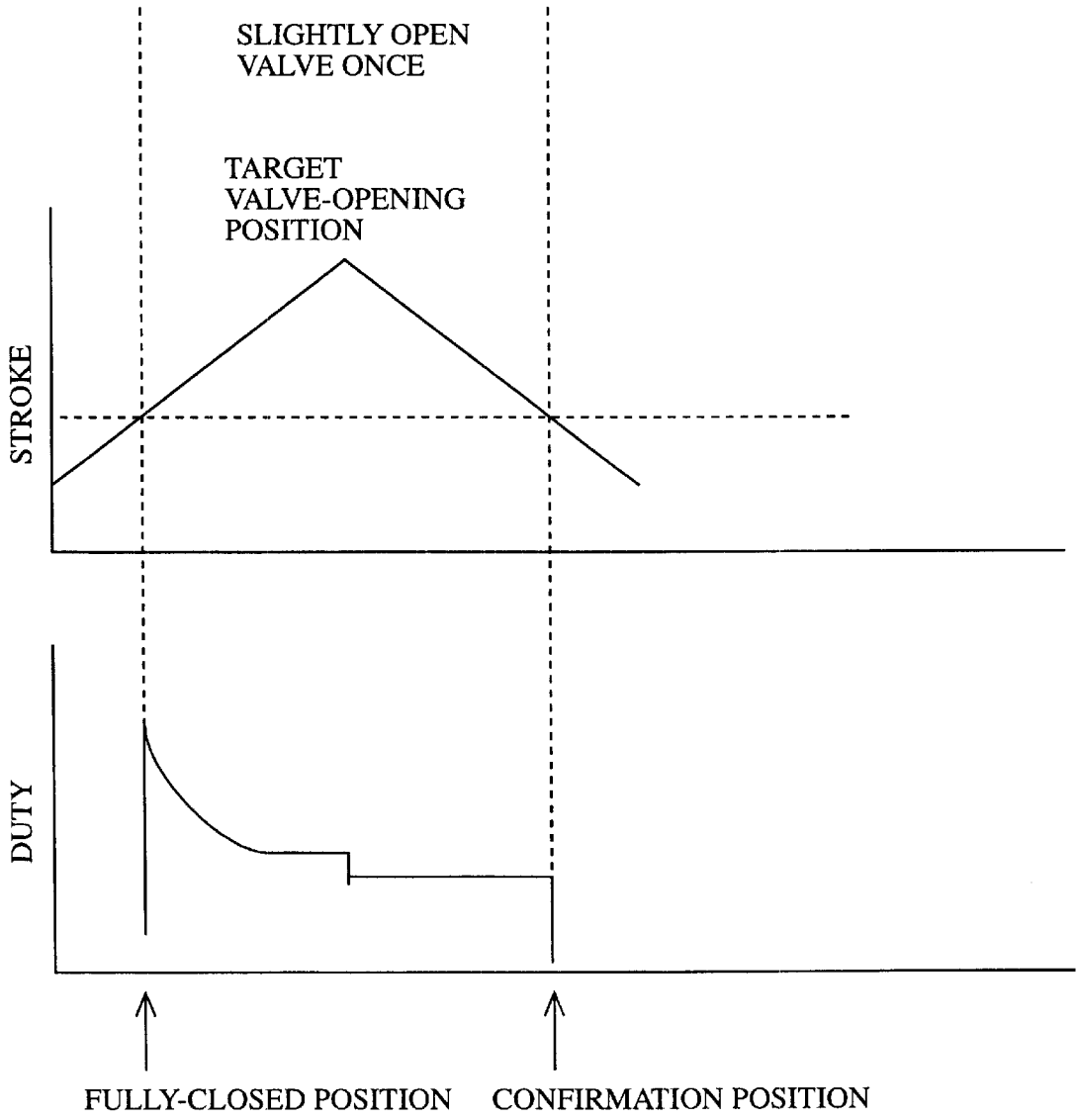
FIG. 20 is a diagram showing the relationships of stroke change of motor shaft and motor driving force (duty) with respect to time, to describe the operation of detecting the valve-opening position according to an embodiment 2 of this invention.
Figure 21:
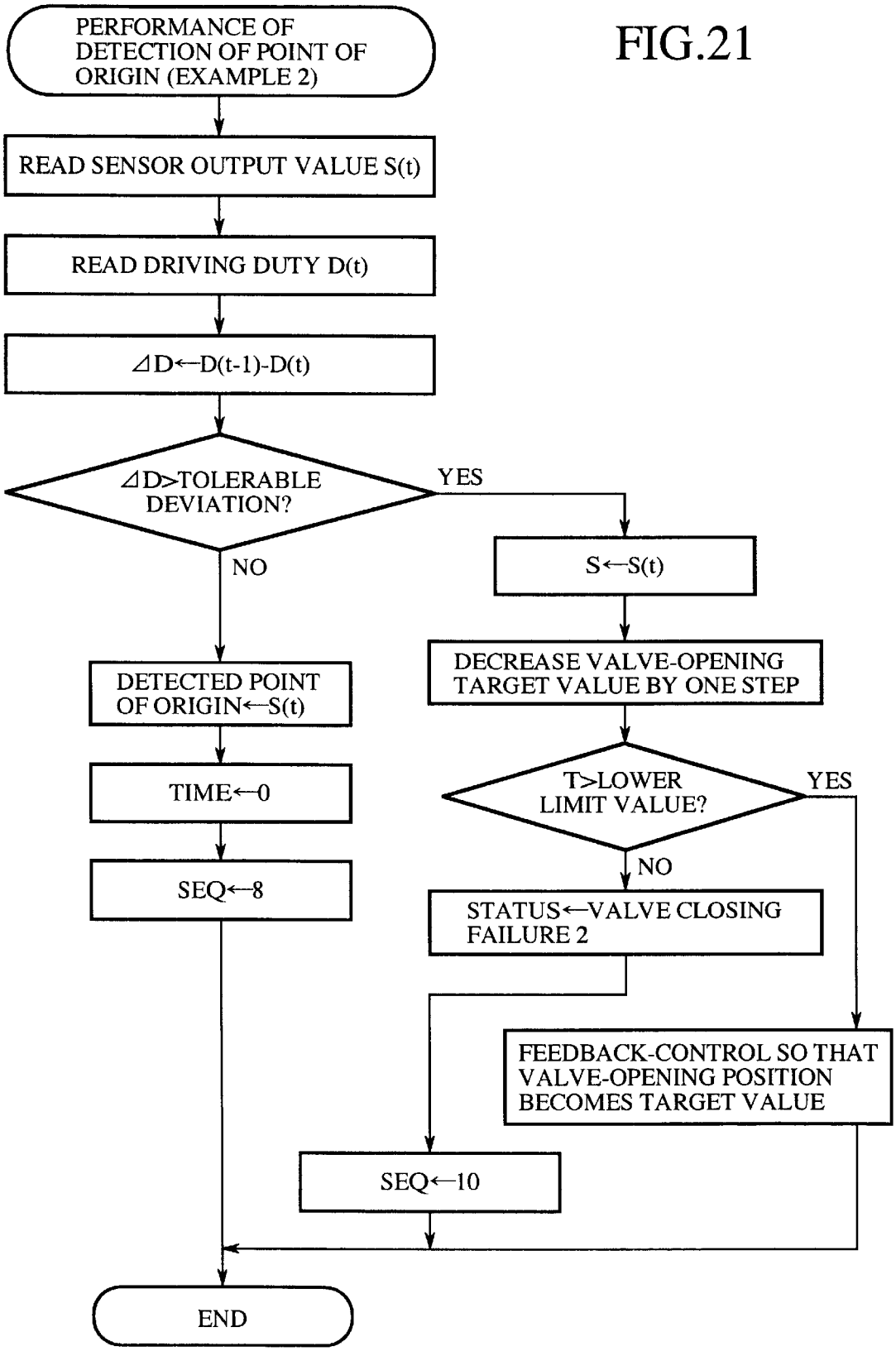
FIG. 21 is a flow chart of performing the detection of valve-opening position.

FIG. 20 is a diagram showing the relationships of stroke change of a motor shaft and motor driving force (duty) with respect to time, to describe the operation of detecting the valve-opening position according to an embodiment 2 of this invention. First, there are repeated several times an operation of opening a valve by giving a valve-opening driving force (duty) to an electric motor M to thereby open the valve and immediately bringing the driving force to "0" to thereby open the valve by an urging force of a return spring. Thereafter, as shown in FIG. 20, by sequentially increasing the driving force in the valve-opening direction to be supplied to the electric motor M, the duty at which the driving force is changed as a result of contact of the motor shaft 31 with the valve shaft 14 is detected. Thereafter, the valve is opened by sequentially increasing the driving force of the electric motor and then the valve is closed by sequentially decreasing the driving force of the electric motor M, and the duty at which the driving force is changed as a result of contact of the motor shaft 31 with the valve shaft 14 is detected. If the deviation between this duty and the earlier detected duty falls within a tolerable deviation, the earlier detected duty is made to be the valve-opening starting position. FIG. 21 is a flow chart for performing the detection of the position for valve opening, and is to perform the similar operations as in FIG. 16. Therefore, its detailed description is omitted.

As described above, according to the embodiment 2, by enabling to accurately detect the valve-opening starting position at the time of opening the valve by means of deviation in duties, the amount of valve opening can be accurately controlled.

EMBODIMENT 3

Figure 1:
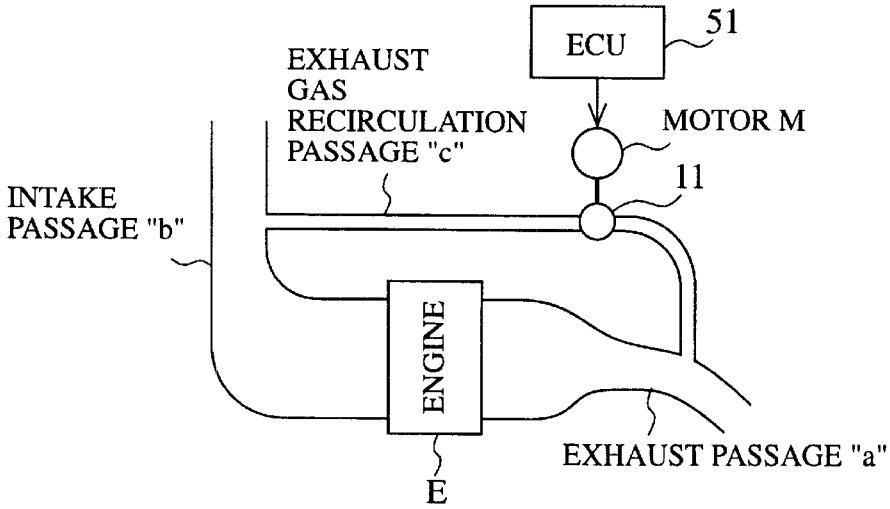
FIG. 1 is a schematic explanation diagram of an engine exhaust system.
Figure 2:
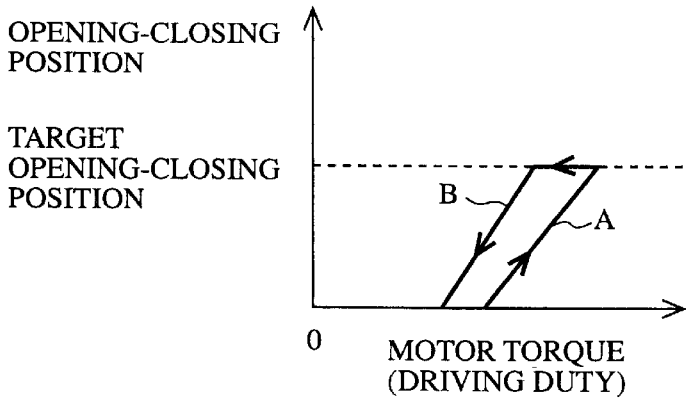
FIG. 2 is a characteristic diagram of motor M torque versus opening-closing position of a control valve in an EGR valve of torque balance drive type.
Figure 3:
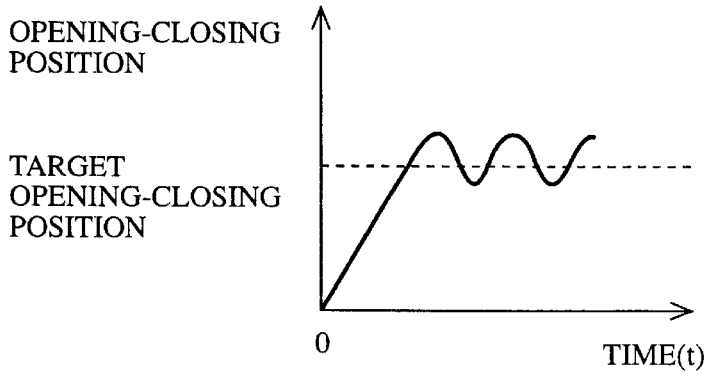
FIG. 3 is a characteristic diagram showing the relationship between time and operation position of motor shaft.
Figure 4:
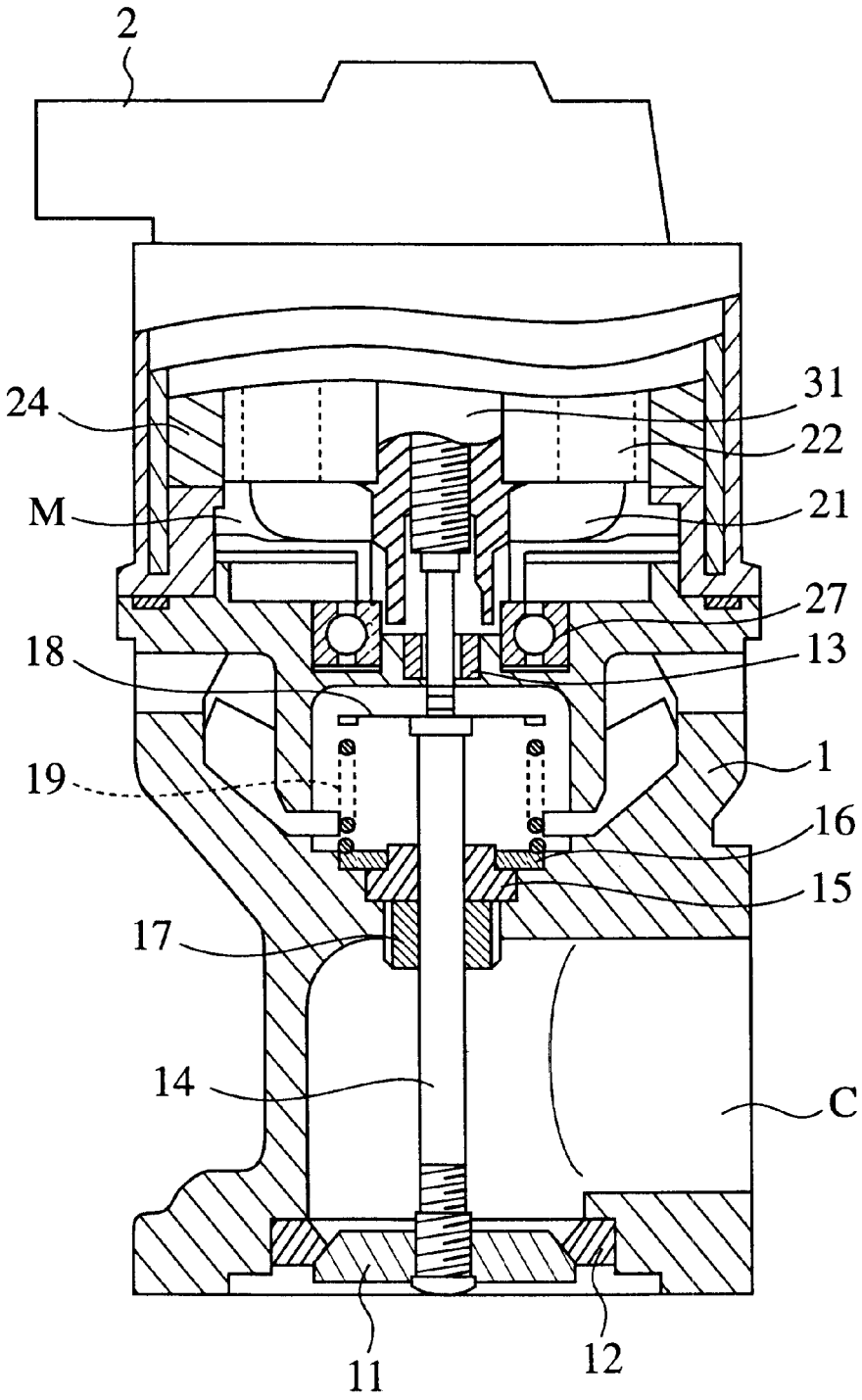
FIG. 4 is a longitudinal sectional view of the EGR valve.
Figure 5:
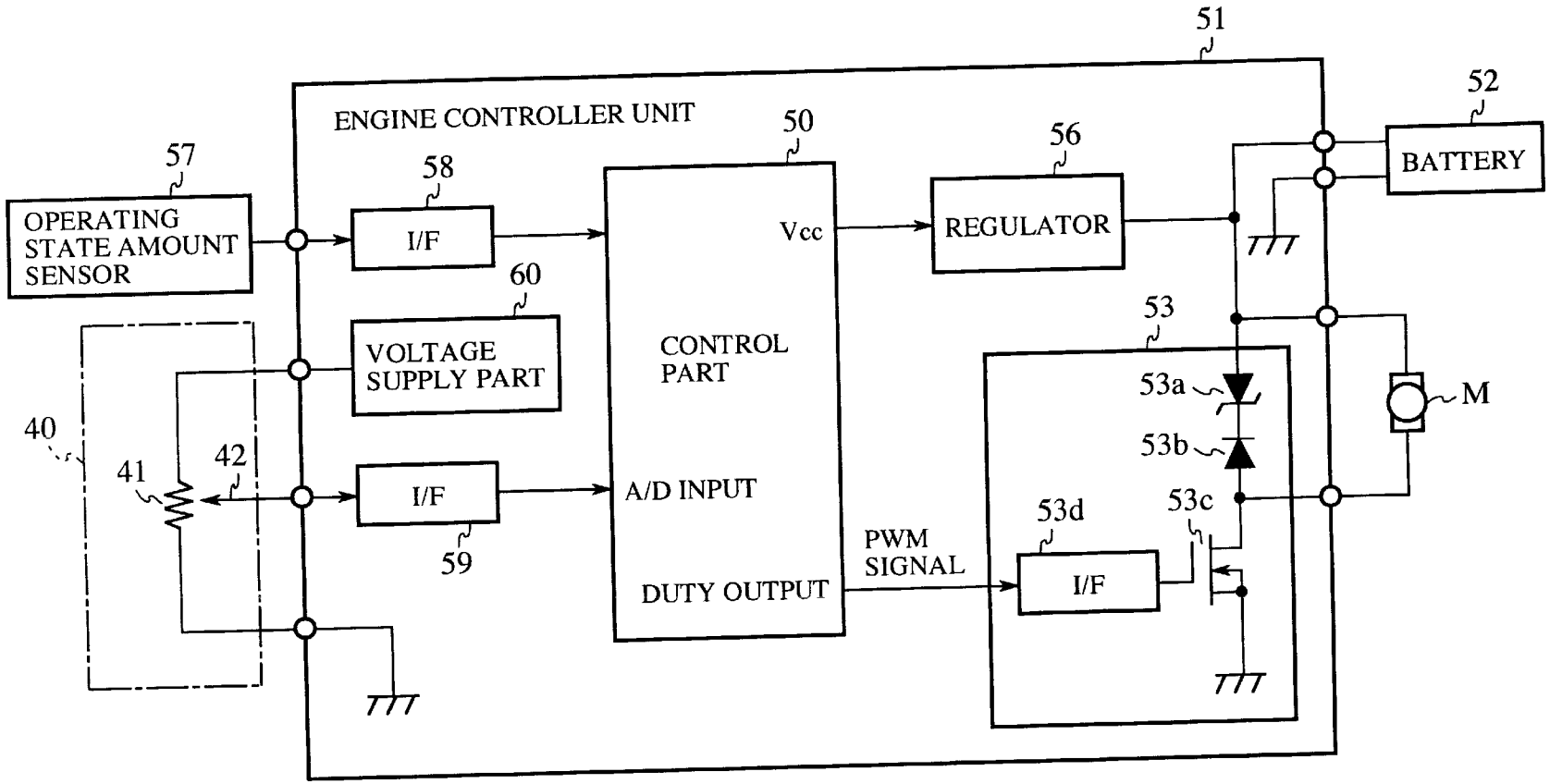
FIG. 5 is an arrangement diagram of a control apparatus in the so-called torque balance drive system using the electric motor M.
Figure 22:
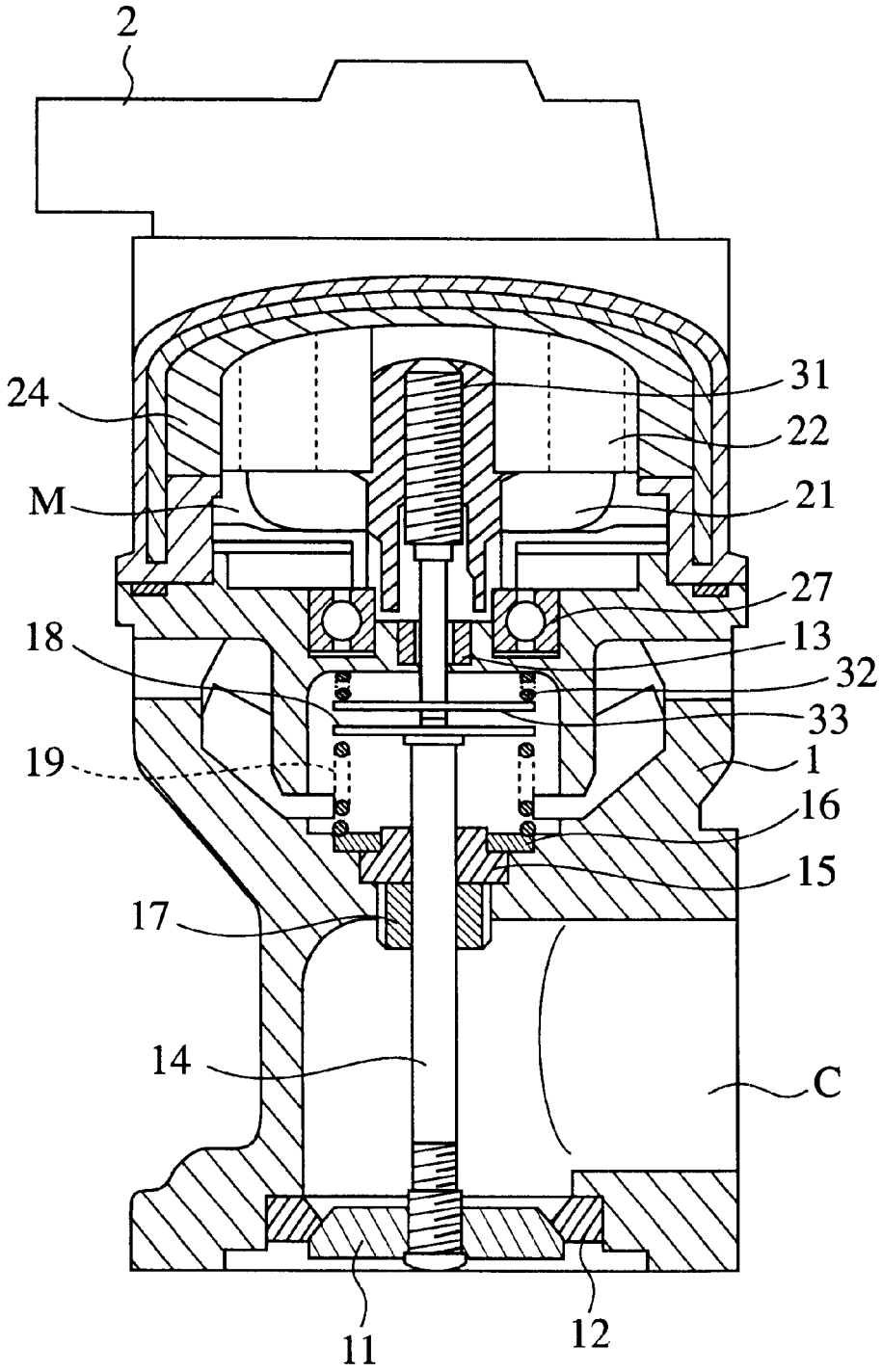
FIG. 22 is a longitudinal sectional view of the EGR valve of this invention.

FIG. 22 is a partially cut-away longitudinal sectional view of the EGR valve according to embodiment 3 of this invention. In the figure, reference numeral 32 denotes an assisting spring which urges the motor shaft 31 in the valve-opening direction with a force smaller than the valve-opening force. The other constitution is the same as that shown in FIG. 4. Therefore, its description is omitted by giving the same reference numerals to the same parts.

The description is now given of the operation.

At the time of closing the valve, if the driving force of the electric motor M is sequentially decreased, the urging force of the return spring 19 gets stronger than the driving force of the electric motor M. As a result, the valve shaft 14 is urged to move in the valve-closing direction while pushing the motor shaft 31. At this time, the assisting spring 32 is compressed by the spring sheet 33 so that the urging force becomes stronger. As a result, the amount of movement of the motor shaft 31 in the valve-closing direction is restricted.

As described above, according to embodiment 3, since the urging force of the assisting spring 32 restricts the movement of the motor shaft 31 in the valve-closing direction, the front end of the motor shaft 31 is surely prevented from strongly striking a stopper which restricts the operating range.

INDUSTRIAL APPLICABILITY

As described hereinabove, the apparatus for controlling the EGR valve according to this invention is suitable for quickly performing the operation of returning part of the exhaust gas in the exhaust passage "a" to the intake passage b in response to the change in the engine operating conditions.

What is claimed is:

1. An apparatus for controlling an exhaust gas recirculation valve comprising:

a valve shaft having an open-close valve;

a return spring for urging said valve shaft in a valve-closing direction;

an electric motor for driving, in a valve-opening direction, a motor shaft abutting said valve shaft;

a position detecting sensor for detecting a position of said motor shaft; and a computing means for computing a valve-opening starting position based on a detected signal of said position detecting sensor which detects, through movement of said motor shaft back and forth in both the valve-opening direction and the valve-closing direction, related positions of said motor shaft and said valve shaft at the time of the movement.

2. The apparatus for controlling an EGR valve according to claim 1, wherein opening and closing operation of said open-close valve is repeated several times prior to an operation of detecting the valve-opening position.

3. The apparatus for controlling an EGR valve according to claim 1, further comprising an assisting spring for urging said motor shaft in a direction opposite to that of said return spring, said urging being made with a force smaller than that of said return spring.

4. The apparatus for controlling an EGR valve according to claim 1, wherein said computing means:

drives said electric motor, thereby opening said open-close valve by urging said valve shaft with said motor shaft;

thereafter sequentially weakens the driving force of said electric motor so as to move said valve shaft in the valve-closing direction by an urging force of said return spring, thereby detecting a motor shaft position at the time of valve closing as a fully-closed position;

further moves said motor shaft in a direction away from said valve shaft and thereafter moves said motor shaft once again in a direction to come into contact with said valve shaft, thereby detecting the contact position of said motor shaft with said valve shaft as a confirmation position; and if a deviation between said confirmation position and said fully-closed position falls within a tolerable deviation, makes said fully-closed position as said valve-opening starting position.

5. The apparatus for controlling an EGR valve according to claim 1, wherein said computing means:

drives said electric motor, thereby opening said open-close valve by urging said valve shaft with said motor shaft;

thereafter sequentially weakens the driving force of said electric motor so as to move said valve shaft in a valve-closing direction by an urging force of said return spring, thereby detecting the motor shaft position at the time of valve closing as a fully-closed position;

further moves said motor shaft in a direction away from said valve shaft and thereafter moves said motor shaft once again in a direction to come into contact with said valve shaft, thereby detecting the contact position of said motor shaft with said valve shaft as a confirmation position; and if a deviation between said confirmation position and said fully-closed position falls outside a tolerable deviation, repeats the above-described operations once again to thereby detect whether the deviation between said confirmation position and said fully-closed position falls within the tolerable deviation.

6. The apparatus for controlling an EGR valve according to claim 1, wherein said computing means:

sequentially increases a driving force to be supplied to said electric motor in the valve-opening direction, thereby detecting a duty at which the driving force changes as a result of contact of said motor shaft with said valve shaft;

opens said open-close valve by sequentially increasing the driving force of said electric motor and thereafter closes said open-close valve by sequentially decreasing the driving force of said electric motor, thereby detecting a duty at which the driving force changes as a result of departing of said motor shaft from said valve shaft; and if a deviation between this duty and the earlier detected duty falls within a tolerable deviation, makes that position of said motor shaft at which the earlier detected duty was detected as said valve-opening starting position.

* * * * *